US010488808B2

(12) United States Patent
Ishida et al.

(10) Patent No.: US 10,488,808 B2
(45) Date of Patent: Nov. 26, 2019

(54) IMAGE FORMING APPARATUS HAVING AN IRRADIATOR IRRADIATING A PHOTOCONDUCTOR

(71) Applicant: Konica Minolta, Inc., Tokyo (JP)

(72) Inventors: Takeshi Ishida, Hachioji (JP); Kazuhiro Kuramochi, Hino (JP); Seisuke Maeda, Hussa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/235,450

(22) Filed: Dec. 28, 2018

(65) Prior Publication Data

US 2019/0212670 A1 Jul. 11, 2019

(30) Foreign Application Priority Data

Jan. 10, 2018 (JP) ..... 2018-001952

(51) Int. Cl.

*G03G 15/16* (2006.01)
*G03G 21/08* (2006.01)
*G03G 15/01* (2006.01)

(52) U.S. Cl.

CPC ..... *G03G 21/08* (2013.01); *G03G 15/0189* (2013.01); *G03G 15/169* (2013.01)

(58) Field of Classification Search

CPC ..... G03G 15/169; G03G 2215/1666; G03G 15/0189; G03G 21/08
USPC ..... 399/296
See application file for complete search history.

(56) References Cited

U.S. PATENT DOCUMENTS 4,819,028 A * 4/1989 Abe ..... G03G 15/0157 347/118
4,897,333 A * 1/1990 Matsushita ..... G03G 13/22 430/119.71
5,241,356 A * 8/1993 Bray ..... G03G 15/0157 399/170
5,280,326 A * 1/1994 Pinhas ..... G03G 15/1605 399/296
5,480,751 A * 1/1996 Williams ..... G03G 15/0131 430/45.31
6,026,267 A * 2/2000 Kimura ..... G03G 15/169 399/156

(Continued)

FOREIGN PATENT DOCUMENTS

JP 06043736 A * 2/1994
JP 2016184060 A 10/2016

*Primary Examiner* — Robert B Beatty
(74) *Attorney, Agent, or Firm* — Lucas & Mercanti, LLP

(57) ABSTRACT

An image forming apparatus includes: a transferer that transfers a toner image formed on a surface of a photo-conductor onto an image carrier; and an irradiator that irradiates the surface of the photo-conductor before transfer with light such that a potential of an image area where the toner image has been formed and a potential of a non-image area where the toner image has not been formed in the photo-conductor before transfer satisfy formula (1):

$$0 \leq |Va| - |Vb| \leq 200 \text{ [V]} \quad (1)$$

where |Va| represents the potential of the image area after the surface of the photo-conductor before transfer is irradiated with light, and |Vb| represents the potential of the non-image area after the surface of the photo-conductor before transfer is irradiated with light.

8 Claims, 6 Drawing Sheets

(56) References Cited

U.S. PATENT DOCUMENTS

| | | | | |
|---|---|---|---|---|
| 8,541,151 | B2 * | 9/2013 | Yu | G03G 5/047 430/59.6 |
| 8,903,285 | B2 * | 12/2014 | Hatano | G03G 15/0189 399/128 |
| 2001/0055504 | A1 * | 12/2001 | Itoh | G03G 15/169 399/296 |

* cited by examiner

FIG. 7

| | PHOTO-CONDUCTOR DRUM | | PRE-TRANSFER ERASE | | | MAIN STATIC ELIMINATOR | POTENTIAL AFTER PRE-TRANSFER ERASE (V) | | DIFFERENCE IN POTENTIAL BETWEEN IMAGE AREA AND NON-IMAGE AREA (V) | EVALUATION ITEM | |
|---|---|---|---|---|---|---|---|---|---|---|---|
| | OCL | CGL | INSTALLATION | WAVELENGTH (nm) | LIGHT AMOUNT (μW) | | IMAGE AREA | NON-IMAGE AREA | | TRANSFER MEMORY | SCATTERING |
| EXAMPLE 1 | PRESENCE | CG-9 | PRESENCE | 800 | 13 | ABSENCE | 249 | 50 | 199 | R3 | R3 |
| EXAMPLE 2 | PRESENCE | CG-9 | PRESENCE | 820 | 13 | ABSENCE | 150 | 51 | 99 | R3 | R4 |
| EXAMPLE 3 | PRESENCE | CG-9 | PRESENCE | 800 | 13 | ABSENCE | 250 | 49 | 201 | R3 | R3 |
| EXAMPLE 4 | PRESENCE | CG-9 | PRESENCE | 800 | 13 | PRESENCE | 251 | 51 | 200 | R4 | R3 |
| EXAMPLE 5 | PRESENCE | CG-1 | PRESENCE | 800 | 13 | ABSENCE | 243 | 49 | 194 | R3 | R3 |
| EXAMPLE 6 | PRESENCE | CG-9 | PRESENCE | 800 | 13 | ABSENCE | 244 | 46 | 198 | R3 | R3 |
| EXAMPLE 7 | ABSENCE | CG-9 | PRESENCE | 800 | 13 | ABSENCE | 233 | 40 | 193 | R4 | R3 |
| EXAMPLE 8 | ABSENCE | CG-9 | PRESENCE | 800 | 13 | PRESENCE | 228 | 42 | 196 | R5 | R3 |
| EXAMPLE 9 | PRESENCE | CG-1 | PRESENCE | 820 | 13 | ABSENCE | 152 | 51 | 101 | R3 | R4 |
| EXAMPLE 10 | PRESENCE | CG-9 | PRESENCE | 820 | 13 | ABSENCE | 152 | 52 | 100 | R3 | R4 |
| EXAMPLE 11 | ABSENCE | CG-9 | PRESENCE | 820 | 13 | ABSENCE | 136 | 41 | 95 | R4 | R4 |
| EXAMPLE 12 | PRESENCE | CG-9 | PRESENCE | 850 | 30 | ABSENCE | 45 | 39 | 6 | R3 | R4 |
| EXAMPLE 13 | PRESENCE | CG-9 | PRESENCE | 850 | 50 | ABSENCE | 38 | 38 | 0 | R3 | R5 |
| COMPARATIVE EXAMPLE 1 | PRESENCE | CG-9 | ABSENCE | — | — | ABSENCE | — | — | — | R1 | R3 |
| COMPARATIVE EXAMPLE 2 | PRESENCE | CG-9 | PRESENCE | 780 | 13 | ABSENCE | 266 | 50 | 216 | R3 | R2 |
| COMPARATIVE EXAMPLE 3 | ABSENCE | CG-9 | ABSENCE | — | — | ABSENCE | — | — | — | R2 | R3 |
| COMPARATIVE EXAMPLE 4 | ABSENCE | CG-9 | PRESENCE | 780 | 13 | ABSENCE | 156 | 51 | 205 | R3 | R2 |

IMAGE FORMING APPARATUS HAVING AN IRRADIATOR IRRADIATING A PHOTOCONDUCTOR

The entire disclosure of Japanese patent Application No. 2018-001952, filed on Jan. 10, 2018, is incorporated herein by reference in its entirety.

BACKGROUND

Technological Field

The present invention relates to an image forming apparatus.

Description of the Related Art

Generally, in an image forming apparatus (printer, copying machine, facsimile, or the like) using an electrophotographic process technique, by emission (exposure) of light based on image data to a uniformly charged photo-conductor (for example, photo-conductor drum), an electrostatic latent image is formed on a surface of the photo-conductor. Then, toner is supplied to the photo-conductor on which the electrostatic latent image has been formed, and the electrostatic latent image is thereby visualized to form a toner image. This toner image is transferred onto a sheet directly or indirectly via an intermediate transfer body, and then heated and pressed by a fixing device to form an image on the sheet.

When a cured surface layer is used for a surface of the photo-conductor, the amount of a transfer current flowing into a non-image area (region where a toner image is not formed) on the surface of the photo-conductor is larger than that of a transfer current flowing into an image area (region where a toner image is formed). As a result, a potential of the non-image area is largely lowered, and transfer memory which is a phenomenon that the potential of the non-image area cannot be returned to a predetermined potential even by subsequent charging may occur. In order to raise a halftone density of a photo-conductor drum at the second and subsequent rounds, for example, as illustrated in FIG. 1, the transfer memory appears as a difference (difference in density) between the density of an area that is a non-image area at the first rotation and is an image area at the second rotation and the density of an area that is an image area at both the first rotation and the second rotation.

In order to prevent occurrence of transfer memory, for example, an image forming apparatus includes an irradiation member for irradiating a photo-conductor before transfer with light (for example, JP 2016-184060 A).

However, even for the image forming apparatus described in JP 2016-184060 A, further improvement of scattering of toner to improve image quality is required when higher quality is demanded.

SUMMARY

An object of the present invention is to provide an image forming apparatus capable of preventing occurrence of transfer memory and suppressing scattering of toner.

To achieve the abovementioned object, according to an aspect of the present invention, an image forming apparatus reflecting one aspect of the present invention comprises: a transferer that transfers a toner image formed on a surface of a photo-conductor onto an image carrier; and an irradiator that irradiates the surface of the photo-conductor before transfer with light such that a potential of an image area where the toner image has been formed and a potential of a non-image area where the toner image has not been formed in the photo-conductor before transfer satisfy formula (1):

$$0 \leq |Va| - |Vb| \leq 200 \text{ [V]} \quad (1)$$

where |Va| represents the potential of the image area after the surface of the photo-conductor before transfer is irradiated with light, and |Vb| represents the potential of the non-image area after the surface of the photo-conductor before transfer is irradiated with light.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 4 is a diagram illustrating disposition of a main static eliminator and the like;

FIG. 7 is a diagram illustrating experimental results of transfer memory and scattering of toner using photo-conductor drums in Examples and the like.

DETAILED DESCRIPTION OF EMBODIMENTS

Figure 2:
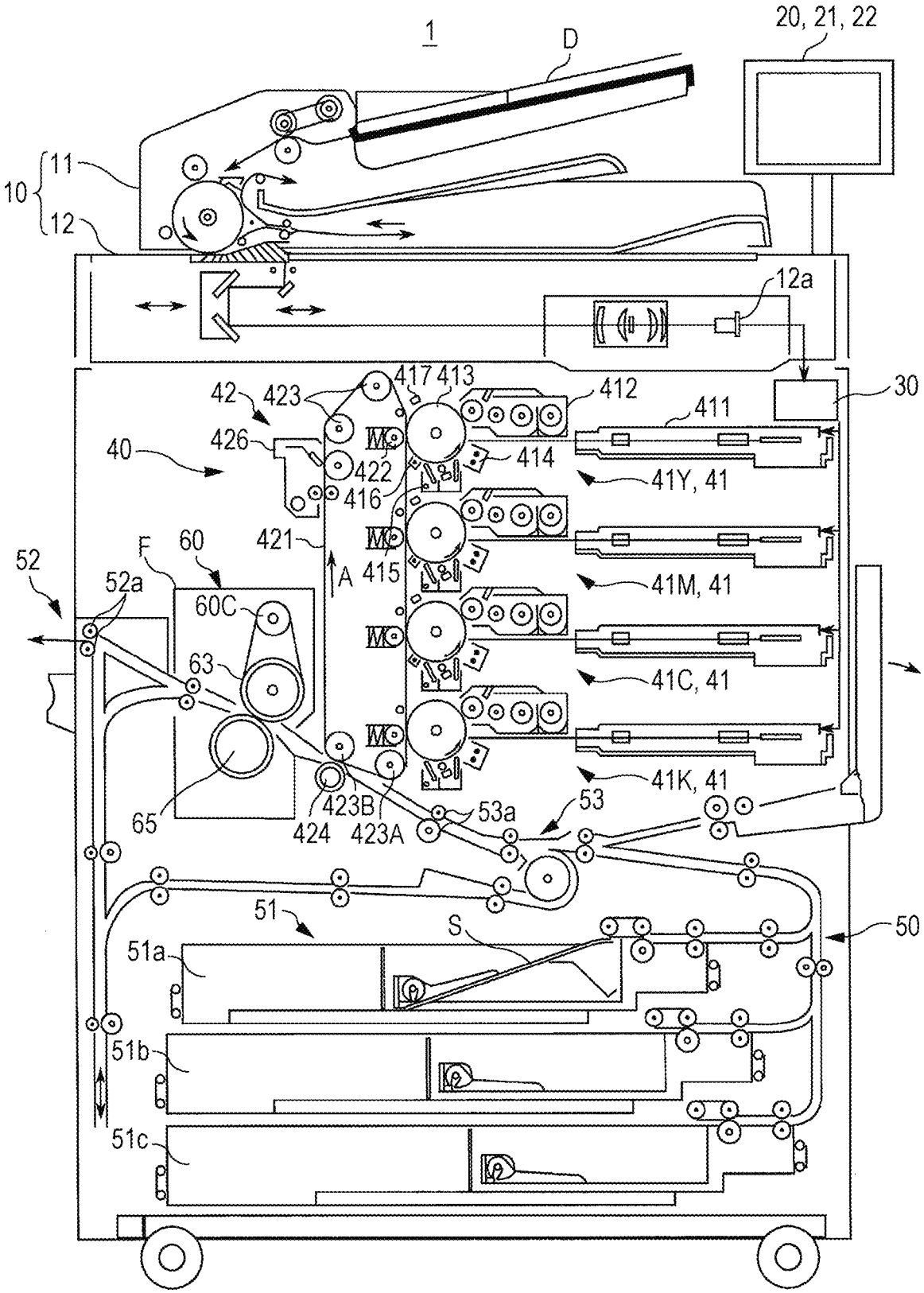
FIG. 2 is a diagram schematically illustrating an image forming apparatus according to an embodiment of the present invention.
Figure 3:
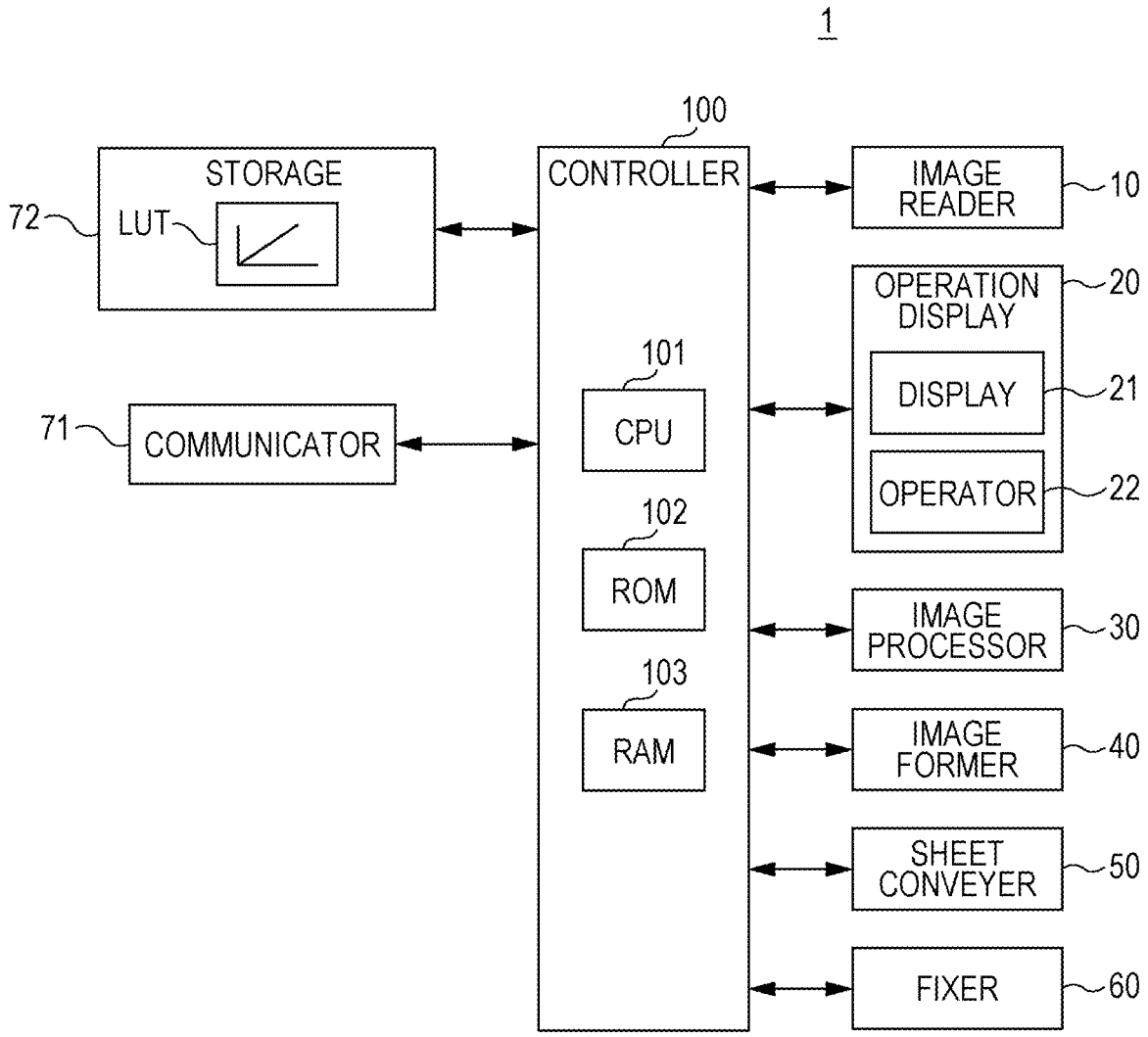
FIG. 3 is a block diagram illustrating the configuration of the image forming apparatus.

Hereinafter, one or more embodiments of the present invention will be described in detail with reference to the drawings. However, the scope of the invention is not limited to the disclosed embodiments. FIG. 2 is a diagram schematically illustrating the entire configuration of an image forming apparatus 1 according to an embodiment of the present invention. FIG. 3 illustrates a main part of a control system of the image forming apparatus 1 according to the present embodiment. The image forming apparatus 1 illustrated in FIGS. 2 and 3 is an intermediate transfer type color image forming apparatus utilizing an electrophotographic process technique. That is, the image forming apparatus 1 primarily transfers toner images of yellow (Y), magenta (M), cyan (C), and black (K) formed on a photo-conductor drum 413 onto an intermediate transfer belt 421 (image carrier), superimposes the four color toner images on the intermediate transfer belt 421, and then secondarily transfers the toner images onto a sheet S (recording medium) to form an image.

In addition, the image forming apparatus 1 adopts a tandem system in which the photo-conductor drums 413 corresponding to the four colors of Y, M, C, and K are disposed in series in a traveling direction of the intermediate transfer belt 421, and the toner images of the colors are sequentially transferred onto the intermediate transfer belt 421 in a single procedure.

As illustrated in FIG. 3, the image forming apparatus 1 includes an image reader 10, an operation display 20, an image processor 30, an image former 40, a sheet conveyer 50, a fixer 60, and a controller 100.

The controller 100 includes a central processing unit (CPU) 101, a read only memory (ROM) 102, a random access memory (RAM) 103, and the like.

The CPU 101 reads a program corresponding to process contents from the ROM 102, develops the program in the RAM 103, and cooperates with the developed program to control an operation of each block of the image forming apparatus 1 in a centralized manner. At this time, the CPU 101 refers to various kinds of data stored in a storage 72. The storage 72 is constituted by, for example, a nonvolatile semiconductor memory (so-called flash memory) or a hard disk drive.

The controller 100 exchanges various kinds of data with an external apparatus (for example, a personal computer) connected to a communication network such as a local area network (LAN) or a wide area network (WAN) via a communicator 71. The controller 100 receives, for example, image data (input image data) transmitted from an external apparatus, and form an image on the sheet S based on the image data. The communicator 71 is constituted by a communication control card such as a LAN card.

The image reader 10 includes an auto document feeder (ADF) 11, a document image scanner (scanner) 12, and the like.

The auto document feeder 11 conveys a document D placed on a document tray with a conveyance mechanism and sends the document D to a document image scanner 12. The auto document feeder 11 can read images of a large number of documents D (including both surfaces) placed on the document tray in succession at once.

The document image scanner 12 optically scans a document conveyed onto a contact glass from the auto document feeder 11 or a document placed on the contact glass, forms an image of reflected light from the document on a light receiving surface of a charge coupled device (CCD) sensor 12*a*, and reads the document image. The image reader 10 generates input image data based on a reading result by the document image scanner 12. The input image data is subjected to a predetermined image process in the image processor 30.

The operation display 20 is constituted by, for example, a liquid crystal display (LCD) with a touch panel, and functions as a display 21 and an operator 22. The display 21 displays various operation screens, an image state, an operation status of each function, and the like according to a display control signal input from the controller 100. The operator 22 includes various operation keys such as a ten-key and a start key, accepts various input operations by a user, and outputs an operation signal to the controller 100.

The image processor 30 includes a circuit that performs a digital image process corresponding to initial setting or user setting on input image data, for example. For example, under control of the controller 100, the image processor 30 performs gradation correction based on gradation correction data (gradation correction table). In addition to the gradation correction, the image processor 30 applies various correction processes such as color correction and shading correction, a compression process, and the like to input image data. The image former 40 is controlled based on image data that has been subjected to these processes.

The image former 40 includes image forming units 41Y, 41M, 41C, and 41K for forming images with color toners of Y component, M component, C component, and K component based on input image data, an intermediate transfer unit 42, and the like.

The image forming units 41Y, 41M, 41C, and 41K for Y component, M component, C component, and K component have similar configurations. For convenience of illustration and description, common constituent elements are denoted by the same reference numeral. When constituent elements are distinguished from one another, Y, M, C, or K is added to a reference numeral. In FIG. 2, only the constituent elements of the image forming unit 41Y for Y component are denoted by reference numerals, and the constituent elements of the other image forming units 41M, 41C, and 41K are not denoted by reference numerals.

The image forming unit 41 includes an exposure device 411, a developing device 412, the photo-conductor drum 413, a charging device 414, a drum cleaning device 415, a main static eliminator 416 (corresponding to a "post-transfer static eliminator" according to an aspect of the present invention), a pre-transfer static eliminator 417, and the like.

The photo-conductor drum 413 is a negatively-charged organic photo-conductor (OPC) obtained by, for example, sequentially laminating an under coat layer (UCL), a charge generation layer (CGL), and a charge transport layer (CTL) on a peripheral surface of an aluminum conductive cylinder (aluminum element tube). The charge generation layer is formed of an organic semiconductor in which a charge generation material (for example, a phthalocyanine pigment) is dispersed in a resin binder (for example, polycarbonate), and generates a pair of positive and negative charges upon exposure by the exposure device 411. The charge transport layer is formed by dispersing a hole transport material (electron donating nitrogen-containing compound) in a resin binder (for example, polycarbonate resin), and transports a positive charge generated in the charge generation layer to a surface of the charge transport layer. An overcoat layer (OCL) is disposed on a surface of the charge transport layer. The overcoat layer includes a polymer compound and suppresses abrasion of a surface of the photo-conductor drum 413 due to contact with the drum cleaning device 415 or the like. Note that the details of the overcoat layer will be described later.

The controller 100 controls a drive current supplied to a drive motor (not illustrated) that rotates the photo-conductor drum 413, and the photo-conductor drum 413 thereby rotates at a constant peripheral speed.

The charging device 414 negatively charges a surface of the photoconductive photo-conductor drum 413 uniformly. The exposure device 411 is constituted by, for example, a semiconductor laser, and irradiates the photo-conductor drum 413 with a laser beam corresponding to an image of each color component. A positive charge is generated in a charge generation layer of the photo-conductor drum 413 and transported to a surface of a charge transport layer. As a result, a surface charge (negative charge) of the photo-conductor drum 413 is neutralized. An electrostatic latent image of each color component is formed on a surface of the photo-conductor drum 413 due to a difference in potential from the surroundings.

The developing device 412 is, for example, a two-component developing type developing device, attaches toners of color components to a surface of the photo-conductor drum 413, and thereby visualizes an electrostatic latent image to form a toner image.

The drum cleaning device 415 includes, for example, a drum cleaning blade in sliding contact with a surface of the photo-conductor drum 413, and removes transfer residual toner remaining on the surface of the photo-conductor drum 413 after primary transfer.

Figure 4:
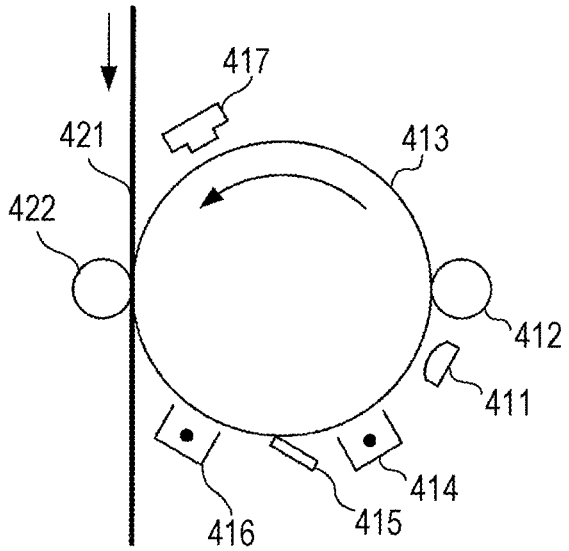

FIG. 4 is a diagram illustrating disposition of the main static eliminator 416 and the like.

As illustrated in FIG. 4, the main static eliminator 416 is disposed between a primary transfer nip (described later) and the charging device 414 in a rotation direction of the photo-conductor drum 413. The main static eliminator 416 applies a voltage having a polarity opposite to the polarity of a charge remaining on a surface of the photo-conductor drum 413 after primary transfer to an electrode to eliminate the remaining charge. Note that the main static eliminator 416 may eliminate the remaining charge by irradiating a surface of the photo-conductor drum 413 with light.

As illustrated in FIG. 4, the pre-transfer static eliminator 417 is disposed between the developing device 412 and the primary transfer nip (described later) in a rotation direction of the photo-conductor drum 413. The pre-transfer static eliminator 417 eliminates a charge by irradiating a surface of the photo-conductor drum 413 on which a toner image has been formed with light. The wavelength of the light with which a surface of the photo-conductor drum 413 is irradiated is in a wavelength range in which a charge generation material (CGM) contained in the charge generation layer has sensitivity.

The intermediate transfer unit 42 includes the intermediate transfer belt 421, a primary transfer roller 422, a plurality of support rollers 423, a secondary transfer roller 424, a belt cleaning device 426, and the like.

The intermediate transfer belt 421 is formed of an endless belt, and is stretched in a loop shape around the plurality of support rollers 423. At least one of the plurality of support rollers 423 is formed of a driving roller, and the others are formed of driven rollers. For example, a roller 423A disposed on a downstream side of the primary transfer roller 422 for K component in a belt traveling direction is preferably a driving roller. This makes it easier to keep the traveling speed of the belt at a primary transferer constant. By rotation of the driving roller 423A, the intermediate transfer belt 421 travels at a constant speed in a direction of arrow A.

The primary transfer roller 422 is disposed on an inner peripheral surface side of the intermediate transfer belt 421 so as to face the photo-conductor drum 413 of each color component. By pressing the primary transfer roller 422 against the photo-conductor drum 413 with the intermediate transfer belt 421 interposed therebetween, a primary transfer nip for transferring a toner image from the photo-conductor drum 413 onto the intermediate transfer belt 421 is formed.

The secondary transfer roller 424 is disposed on an outer peripheral surface side of the intermediate transfer belt 421 so as to face a backup roller 423B disposed on a downstream side of the driving roller 423A in the belt traveling direction. By pressing the secondary transfer roller 424 against the backup roller 423B with the intermediate transfer belt 421 interposed therebetween, a secondary transfer nip for transferring a toner image from the intermediate transfer belt 421 onto the sheet S is formed.

When the intermediate transfer belt 421 passes through the primary transfer nip, the toner image on the photo-conductor drum 413 is sequentially superimposed and primarily transferred onto the intermediate transfer belt 421. Specifically, by applying a primary transfer bias to the primary transfer roller 422 and imparting a charge having a polarity opposite to that of toner to the back side of the intermediate transfer belt 421 (side in contact with the primary transfer roller 422), the toner image is electrostatically transferred onto the intermediate transfer belt 421.

Thereafter, when the sheet S passes through the secondary transfer nip, the toner image on the intermediate transfer belt 421 is secondarily transferred onto the sheet S. Specifically, by applying a secondary transfer bias to the secondary transfer roller 424 and imparting a charge having a polarity opposite to that of toner to the back side of the sheet S (side in contact with the secondary transfer roller 424), the toner image is electrostatically transferred onto the sheet S. The sheet S onto which the toner image has been transferred is conveyed toward the fixer 60.

The belt cleaning device 426 includes, for example, a belt cleaning blade in sliding contact with a surface of the intermediate transfer belt 421, and removes transfer residual toner remaining on the surface of the intermediate transfer belt 421 after the secondary transfer. Note that instead of the secondary transfer roller 424, a configuration (so-called belt-type secondary transfer unit) in which a secondary transfer belt is stretched in a loop shape around a plurality of support rollers including a secondary transfer roller may be adopted.

The fixer 60 includes an upper pressure roller 63 disposed on a side of a fixing surface (surface on which a toner image is formed) of the sheet S, a lower pressure roller 65 disposed on a side of the back surface (surface opposite to the fixing surface) of the sheet S, a heating source 60C, and the like. By pressing the lower pressure roller 65 against the upper pressure roller 63, a fixing nip that nips and conveys the sheet S is formed.

In the fixer 60, a toner image is secondarily transferred, and the conveyed sheet S is heated and pressed by the fixing nip to fix the toner image to the sheet S. The fixer 60 is disposed as a unit in a fixing device F. Details of the fixer 60 will be described later.

The sheet conveyer 50 includes a sheet feeder 51, a sheet discharger 52, a conveying path 53, and the like. Three sheet feeding tray units 51*a* to 51*c* constituting the sheet feeder 51 house the sheets S identified based on basis weight, size, and the like according to the kind set in advance. The conveying path 53 includes a plurality of conveying roller pairs such as a resist roller pair 53*a*.

The sheets S housed in the sheet feeding tray units 51*a* to 51*c* are sent out one by one from the uppermost portion and are conveyed to the image former 40 by the conveying path 53. At this time, the inclination of the fed sheet S is corrected, and conveyance timing is adjusted by a resist roller portion in which the resist roller pair 53*a* is disposed. Then, in the image former 40, a toner image of the intermediate transfer belt 421 is secondarily transferred collectively onto one surface of the sheet S, and a fixing step is performed in the fixer 60. The sheet S on which an image has been formed is discharged to the outside of the apparatus by the sheet discharger 52 having a discharge roller 52*a*.

The main static eliminator 416 in the image forming apparatus 1 eliminates a charge remaining on a surface of the photo-conductor drum 413 by discharge, and thereby can prevent occurrence of transfer memory. In addition, the pre-transfer static eliminator 417 irradiates a surface of the photo-conductor drum 413 before transfer with light, and thereby can further prevent occurrence of transfer memory. However, when the surface of the photo-conductor drum 413 before transfer is irradiated with light, scattering of toner may occur.

Figure 5:
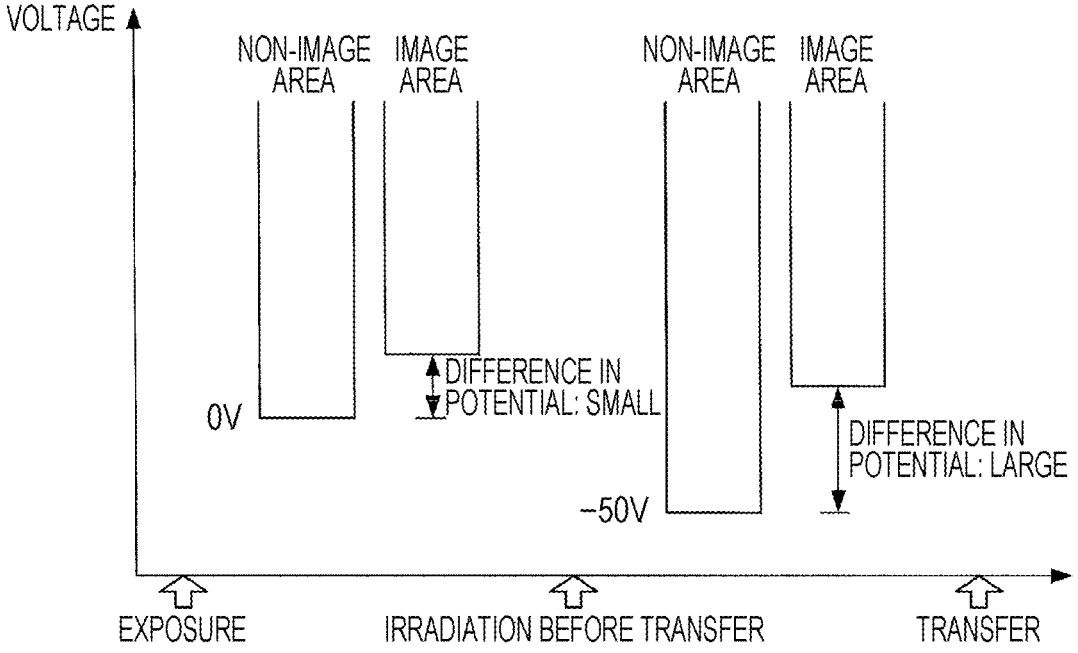
FIG. 5 is a diagram for explaining a cause of scattering of toner.

Hereinafter, scattering of toner will be described with reference to FIG. 5. For example, when there is a cyan toner in an image area (region where a toner image has been formed), and the absorption wavelength of cyan (wavelength of high absorption ratio) and the wavelength of light (light source wavelength) with which a surface of the photo-conductor drum 413 is irradiated from the pre-transfer static eliminator 417 overlap with each other, a voltage drop of the charge generation layer (CGL) in the image area is smaller than a voltage drop of CGL in a non-image area (region where a toner image is not formed) as illustrated in FIG. 5. As a result, the amount of positive charges moving from CGL to a surface in the non-image area is larger than the amount of positive charges moving from CGL to a surface in the image area, and a difference in potential between the image area and the non-image area increases. As a result, it is considered that scattering of toner occurs from the image area to the non-image area. According to the above discussion, scattering of toner becomes worse in accordance with the absorption ratio of toner with respect to a light source wavelength.

In the present embodiment, the light source wavelength of the pre-transfer static eliminator 417 is set to a wavelength at which the absorption ratio of toner is low. In addition, the light source wavelength of the pre-transfer static eliminator 417 is set to a wavelength having such a property as to reduce a difference in potential between the image area and the non-image area.

Next, the absorption ratios [%] of a cyan toner, a magenta toner, and a yellow toner with respect to a light source wavelength will be described.

Each of the absorption ratios of the toners can be obtained by experiment or the like. For example, the absorption ratio of the cyan toner with respect to a light source wavelength of 555 nm to 750 nm is 80% or more. In other words, it can be said that the range from 555 nm to 750 nm is an absorption wavelength of the cyan toner (wavelength of high absorption ratio).

In addition, for example, the absorption ratio of the magenta toner with respect to a light source wavelength of 505 nm to 590 nm is 80% or more. In other words, it can be said that the range from 505 nm to 590 nm is an absorption wavelength of the magenta toner.

In addition, for example, the absorption ratio of the yellow toner with respect to a light source wavelength of 380 nm to 480 nm is 80% or more. In other words, it can be said that the range from 380 nm to 480 nm is an absorption wavelength of the yellow toner.

The above light source wavelength is an absorption wavelength of toner, and scattering of toner is significantly observed at the light source wavelength. Therefore, the light source wavelength has a problem in practical use and is not acceptable. The light source wavelength needs to be a wavelength having a property of suppressing scattering of toner. Note that the light source wavelength needs to be a wavelength at which the charge generation layer (CGL) of the photo-conductor drum 413 has sensitivity so as to be able to prevent occurrence of transfer memory by eliminating a charge of a surface of the photo-conductor drum 413.

The light source wavelength (wavelength with no problem in practical use) at which scattering of toner is acceptable is determined based on a combination of the color of a toner and the sensitivity of CGL. For example, when the absorption ratio of toner in a case where scattering of a cyan toner is acceptable is set to, for example, 40% or less, the light source wavelength at which scattering of the cyan toner is acceptable is 800 nm or more. Therefore, the light source wavelength of the pre-transfer static eliminator 417 in the image forming unit 41C for C component is 800 nm or more. Note that the light source wavelength of 800 nm or more is also a wavelength at which scattering of a magenta toner and a yellow toner is acceptable. Therefore, the light source wavelength of the pre-transfer static eliminator 417 in each of the image forming unit 41M for M component and the image forming unit 41Y for Y component may be 800 nm or more.

Figure 6A:
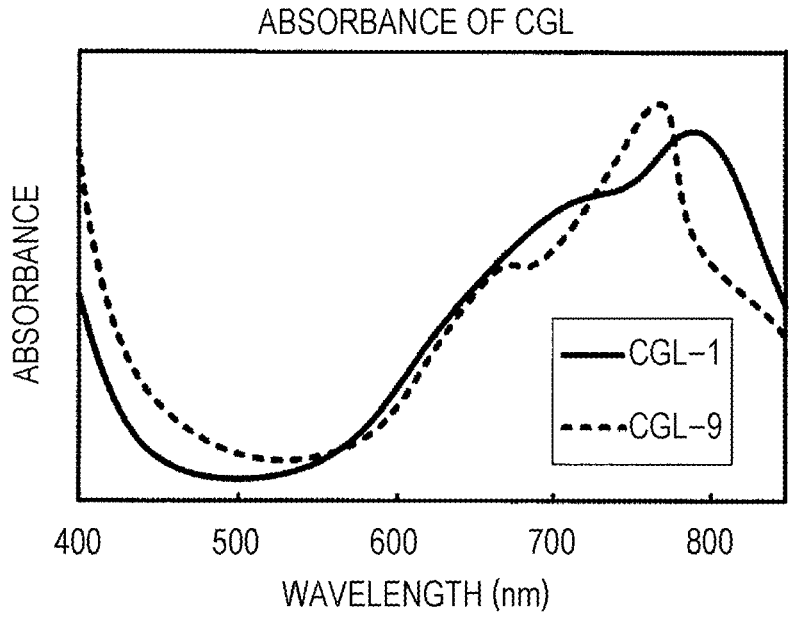
FIG. 6A is a diagram illustrating the absorbance of a charge generation layer with respect to a light source wavelength.
Figure 6B:
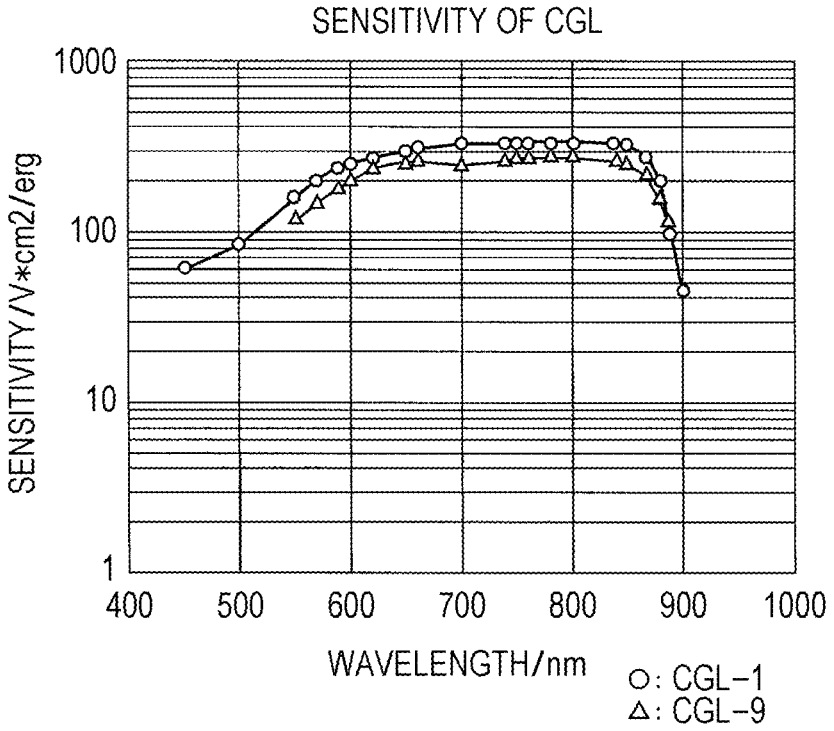
FIG. 6B is a diagram illustrating the sensitivity of a charge generation layer with respect to a light source wavelength.

Next, the absorbance and sensitivity of CGL will be described with reference to FIGS. 6A and 6B. FIG. 6A is a diagram illustrating the absorbance of CGL with respect to a light source wavelength, and FIG. 6B is a diagram illustrating the sensitivity of CGL with respect to a light source wavelength. Note that the absorbance is expressed by absorbance=log ($I_0$/I) when an incident light amount $I_0$ becomes I after light passes through CGL. The sensitivity is expressed in V·cm$^2$/erg.

FIG. 6A illustrates the absorbances of CGL-1 and CGL-9 as samples. As illustrated in FIG. 6A, the absorbance of CGL drops when the light source wavelength exceeds 800 nm. Here, CGL-1 represents a photo-conductor drum prepared in synthesis (1) of a pigment described later, and CGL-9 represents a photo-conductor drum prepared in synthesis (2) of a pigment described later.

FIG. 6B illustrates the sensitivities of the samples CGL-1 and CGL-9. As illustrated in FIG. 6B, the sensitivity of CGL drops when the light source wavelength exceeds 850 nm.

In other words, the light source wavelength that can suppress scattering of toner is 800 nm or more. In addition, the light source wavelength at which CGL has sensitivity is 850 nm or less.

Incidentally, when the light source wavelength is less than 800 nm, light is absorbed by the cyan toner in the image area, and therefore it is difficult to obtain an effect of preventing scattering of toner. In addition, when the light source wavelength exceeds 850 nm, the sensitivity of the photo-conductor drum 413 is lowered. Therefore, it is difficult to eliminate a charge of a surface of the photo-conductor drum 413, and an effect of preventing occurrence of transfer memory is lowered.

From the above results, the light source wavelength of light with which a surface of the photo-conductor drum 413 before transfer is irradiated from the pre-transfer static eliminator 417 is set to 800 nm or more and 850 nm or less. In addition, when the light source wavelength is increased in a range of 800 nm to 850 nm, the absorption ratio of toner is reduced, and therefore an effect of preventing scattering of toner can be enhanced.

A difference in potential between a potential Va of an image area and a potential Vb of a non-image area after a surface of the photo-conductor drum 413 before transfer is irradiated with light from the pre-transfer static eliminator 417 is represented by $0 \leq |Va| - |Vb| \leq 200$ [V] when the light source wavelength of the pre-transfer static eliminator 417 is set to 800 nm or more and 850 nm or less.

Note that the effect of preventing scattering of toner increases as the difference in potential decreases, and therefore the difference in potential is more preferably $0 \leq |Va| - |Vb| \leq 100$ [V]. By decreasing the difference in potential, it is possible to enhance the effect of preventing scattering of toner.

By the way, for example, the light source wavelength varies with a change in temperature. It is difficult to set the difference in potential to 0 [V] due to instability of the light source wavelength. Therefore, the practical difference in potential is set to $5 \leq |Va|-|Vb| \leq 200$ [V] or $5 \leq |Va|-|Vb| \leq 100$ [V].

The above image forming apparatus 1 includes an image forming unit that transfers a toner image formed on the photo-conductor drum 413 onto a recording medium, and has a difference of 0 [V] or more and 200 [V] or less between the potential of the image area and the potential of the non-image area after a surface of the photo-conductor drum 413 before transfer is irradiated with light. As a result, the difference in potential between the image area and the non-image area is reduced, and therefore the effect of suppressing scattering of toner can be enhanced. In addition, light with which the photo-conductor drum 413 is irradiated eliminates a charge of a surface of the photo-conductor drum 413, and can prevent occurrence of transfer memory.

In addition, according to the image forming apparatus 1, the main static eliminator 416 eliminates a charge of a surface of the photo-conductor drum 413, and a difference in potential between the image area and the non-image area is thereby reduced to further prevent occurrence of transfer memory.

Incidentally, in the image forming apparatus 1, the pre-transfer static eliminator 417 is disposed in each of the image forming units 41 for Y component, M component, C component, and K component. However, the present invention is not limited thereto. Scattering of toner tends to occur particularly when a cyan toner is developed. Therefore, the pre-transfer static eliminator 417 may be disposed only in the image forming unit 41C that transfers a cyan toner image onto a recording medium.

Besides, the entire part of the above embodiment merely illustrates an example of implementation of the present invention, and the technical scope of the present invention should not be limitedly interpreted thereby. That is, the present invention can be implemented in various forms without departing from the gist or the main features thereof.

Hereinafter, the present invention will be described in detail with reference to Examples, but the present invention is not limited only to the following Examples.

Preparation Example 1 of Photo-Conductor

A surface of an aluminum cylinder having a diameter of 30 mm was cut to prepare a conductive support [1] having a finely roughened surface.

(Formation of Intermediate Layer)

A dispersion having the following composition was diluted twice with the same mixed solvent. The resulting solution was allowed to stand overnight, and then filtered (filter: Rigimesh 5 μm filter manufactured by Nihon Pall Ltd. was used) to prepare an intermediate layer forming coating liquid [1].

Binder resin: polyamide resin "CM 8000" (manufactured by Toray Industries, Inc.) 1 part Metal oxide particles: titanium oxide "SMT 500 SAS" (manufactured by Tayca Corporation) 3 parts Solvent: methanol 10 parts Dispersing was performed for 10 hours in a batch system using a sand mill as a dispersing machine.

The intermediate layer forming coating liquid [1] was applied onto the conductive support [1] by a dip coating method to form an intermediate layer [1] having a dry film thickness of 2 μm.

(Formation of Charge Generation Layer)

20 parts of a charge generation material: the following pigment (CG-1), 10 parts of a binder resin: polyvinyl butyral resin "#6000-C" (manufactured by Denka Company Limited), 700 parts of a solvent: t-butyl acetate, and 300 parts of a solvent: 4-methoxy-4-methyl-2-pentanone were mixed and dispersed for 10 hours using a sand mill to prepare a charge generation layer forming coating liquid [1]. The charge generation layer forming coating liquid [1] was applied onto the intermediate layer [1] by a dip coating method to form a charge generation layer [1] having a dry film thickness of 0.3 μm.

<Synthesis of Pigment (CG-1)>

(1) Synthesis of Amorphous Titanyl Phthalocyanine 29.2 parts of 1,3-diiminoisoindoline was dispersed in 200 parts of o-dichlorobenzene. 20.4 parts of titanium tetra-n-butoxide was added thereto, and the resulting mixture was heated at 150 to 160° C. for five hours under a nitrogen atmosphere. The resulting solution was allowed to cool. Thereafter, the precipitated crystal was filtered, washed with chloroform, washed with a 2% hydrochloric acid aqueous solution, washed with water, washed with methanol, and dried to obtain 26.2 parts (yield 91%) of crude titanyl phthalocyanine.

Subsequently, the crude titanyl phthalocyanine was stirred in 250 parts of concentrated sulfuric acid at 5° C. or lower for one hour to be dissolved, and the resulting solution was poured into 5000 parts of water at 20° C. The precipitated crystal was filtered and thoroughly washed with water to obtain 225 parts of a wet paste product.

The wet paste product was frozen in a freezer and thawed again, and then filtered and dried to obtain 24.8 parts (yield 86%) of amorphous titanyl phthalocyanine.

(2) Synthesis of (2R,3R)-2,3-Butanediol Adduct Titanyl Phthalocyanine (CG-9)

10.0 parts of the amorphous titanyl phthalocyanine and 0.94 parts (0.6 equivalent ratio) (equivalent ratio to titanyl phthalocyanine, hereinafter the same) of (2R,3R)-2,3-butanediol were mixed with 200 parts of orthodichlorobenzene (ODB). The resulting mixture was heated and stirred at 60 to 70° C. for 6.0 hours. The resulting solution was allowed to stand overnight. Thereafter, methanol was added thereto, and the resulting crystal was filtered. The filtered crystal was washed with methanol to obtain 10.3 parts of GC-9 (pigment containing (2R,3R)-2,3-butanediol adduct titanyl phthalocyanine). In an X-ray diffraction spectrum of the pigment (CG-9), there were clear peaks at 8.3°, 24.7°, 25.1°, and 26.5°. In a mass spectrum, there were peaks at 576 and 648. In an IR spectrum, absorption of Ti═O appeared near 970 $cm^{-1}$, and absorption of O—Ti—O appeared near 630 $cm^{-1}$. In thermal analysis (TG), a reduction in mass of about 7% was observed at 390 to 410° C. Therefore, the pigment (CG-9) is estimated to be a mixture of a 1:1 adduct of titanyl phthalocyanine and (2R,3R)-2,3-butanediol and a non-adduct (not added) titanyl phthalocyanine.

The BET specific surface area of the obtained pigment (CG-9) was measured with a fluid type specific surface area automatic measuring apparatus (micrometrics/flow sorb type: Shimadzu Corporation), and was 31.2 $m^2/g$.

(Formation of Charge Transport Layer)

225 parts of a charge transport material: the following compound A, 300 parts of a binder resin: polycarbonate resin "Z300" (manufactured by Mitsubishi Gas Chemical Company, Inc.), 6 parts of an antioxidant "Irganox 1010" (manufactured by Japan Ciba Geigy), 1600 parts of a solvent: tetrahydrofuran (THF), 400 parts of a solvent: toluene, and 1 part of silicone oil "KF-50" (manufactured by Shin-Etsu Chemical Co., Ltd.) were mixed and dissolved to prepare a charge transport layer forming coating liquid [1].

This charge transport layer forming coating liquid [1] was applied onto the charge generation layer [1] using a circular slide hopper applicator to form a charge transport layer [1] having a dry film thickness of 20 μm.

[Chemical formula 1]

Compound A

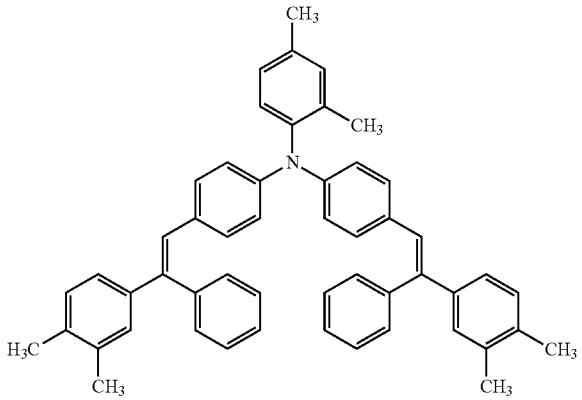

[Chemical formula 2]

Compound S-13

$CH_2{=}C(CH_3)COO(CH_2)_2Si(OCH_3)_3$

[Chemical formula 3]

Compound M1

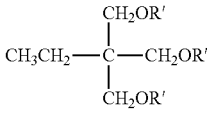

(Formation of Overcoat Layer)

(1) Preparation of Metal Oxide Fine Particles

A mixed liquid containing 100 parts of tin oxide (number average primary particle diameter: 20 nm), 30 parts of the above exemplified compound (S-13) as a surface treatment agent, and 300 parts of a mixed solvent of toluene/isopropyl alcohol=1/1 (mass ratio) was put in a sand mill together with zirconia beads and stirred at about 40° C. at a rotation speed of 1500 rpm. Furthermore, the above treated mixture was taken out, put into a Henschel mixer, stirred at a rotation speed of 1500 rpm for 15 minutes, and then dried at 120° C. for three hours. A surface treatment of the tin oxide with the compound having a radically polymerizable functional group was thereby terminated to obtain surface treated tin oxide. This is referred to as metal oxide fine particles [1]. By the surface treatment with the compound having a radically polymerizable functional group, the particle surfaces of the tin oxide were covered with the above exemplified compound (S-13).

(2) Formation of Overcoat Layer 100 parts of the metal oxide fine particles [1], 100 parts of a polymerizable compound: the above exemplified compound (M1), 320 parts of a solvent: sec-butanol, and 80 parts of a solvent: tetrahydrofuran (THF) were mixed under light shielding, and dispersion was performed using a sand mill as a dispersing machine for five hours. Thereafter, 10 parts of a polymerization initiator "Irgacure" (manufactured by BASF Japan Co., Ltd.) was added thereto, and the resulting mixture was stirred under light shielding for dissolution to prepare an overcoat layer forming coating liquid [1]. This overcoat layer forming coating liquid [1] was applied onto the charge transport layer [1] using a circular slide hopper applicator to form a coating film. Thereafter, this coating film was dried at room temperature for 15 minutes and irradiated with ultraviolet rays at a lamp power of 1 kW for one minute under a nitrogen flow with a distance of 10 mm between a light source and the coating film using a xenon lamp to form an overcoat layer [1] having a dry film thickness of 3.0 μm, thus preparing a photo-conductor [1].

<Method for Manufacturing Photo-Conductor without Surface Overcoat Layer>

A photo-conductor was manufactured by changing the dry film thickness of the charge transport layer (described above) from 20 μm to 26 μm and not forming the overcoat layer in the charge transport layer of the cured surface layer photo-conductor.

[Evaluation]

As an evaluation machine, an apparatus "bizhub PRESS C1100" having the configuration basically illustrated in FIG. 2 and manufactured by Konica Minolta, Inc. was used. Furthermore, to the apparatus, a pre-transfer static eliminator and a photo-conductor corresponding to Examples and the like were attached to provide an evaluation machine.

<Transfer Memory>

Figure 1:
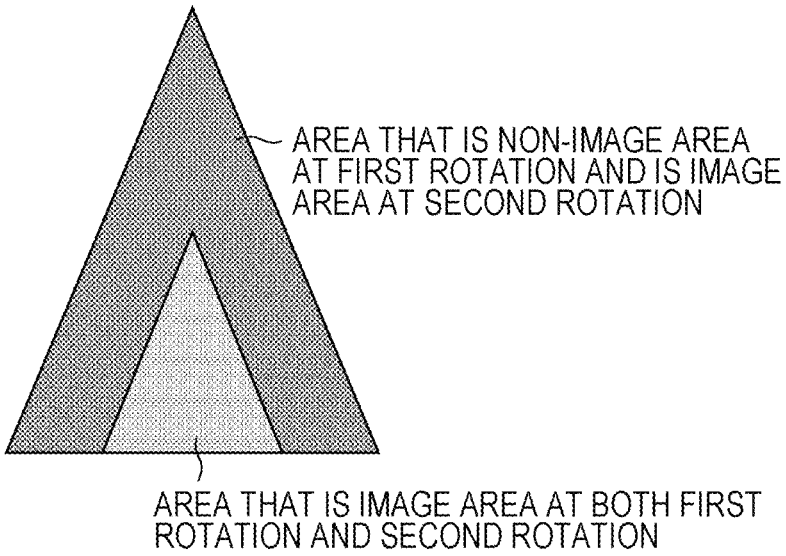
FIG. 1 is a diagram illustrating an example of a phenomenon caused by transfer memory.

A cyan solid image of FIG. 1 was printed on A3 size "POD gross coated paper (100 g/m$^2$)" (manufactured by Oji Paper Co., Ltd.) in an environment of a temperature of 10° C. and a humidity of 15%. At this time, transfer memory (difference in density between image area and non-image area) appearing in a rotation cycle of a photo-conductor drum was visually observed, and ranked and evaluated according to the following criteria. According to the transfer memory (difference in density), five ranks of R5 to R1 were set. R3 or higher was acceptable. Note that R1 is a rank in which transfer memory is observed very clearly. R2 is a rank in which transfer memory is observed clearly. R3 is a rank in which transfer memory is observed slightly. R4 is a rank in which transfer memory is hardly observed. R5 is a rank in which transfer memory is not observed.

<Scattering of Toner>

A monochromatic thin line chart of 1200 dpi and 8 dots was printed on A3 size "POD gross coated paper (100 g/m$^2$)" (manufactured by Oji Paper Co., Ltd.) in an environment of a temperature of 10° C. and a humidity of 15%, and the amount of toner scattered on both sides of the thin line was visually observed and evaluated. In accordance with scattering of toner, the rank was set to 5 ranks of R5 to R1. R3 or higher was acceptable. Note that R1 is a rank in which scattering is observed extremely significantly. R2 is a rank in which scattering of toner is clearly observed. R3 is a rank in which scattering of toner is observed slightly. R4 is a rank in which scattering of toner is hardly observed. R5 is a rank in which scattering of toner is not observed at all.

<Absorption Ratio of Pre-Transfer Erase in Image Area>

The same amount of toner as the image density was printed on a PET sheet, and the absorption ratio of the toner with respect to a light source wavelength of the pre-transfer static eliminator was measured with a UH 4150 type spectrophotometer.

<Pre-Transfer Erase Wavelength>

The light source wavelength of the pre-transfer static eliminator was measured with a spectral radiance meter CS-2000 (manufactured by Konica Minolta, Inc.).

FIG. 7 is a diagram illustrating experimental results of transfer memory and scattering of toner using photo-conductor drums in Examples and the like. Note that "CG-1" in FIG. 7 represents a charge generation layer in which an amorphous titanyl phthalocyanine pigment (CG-1) has been synthesized. "CG-9" represents a charge generation layer in which 2,3-butanediol adduct titanyl phthalocyanine (CG-9) has been synthesized. "Pre-transfer erase" indicates that the pre-transfer static eliminator eliminates a charge by irradiating a surface of a photo-conductor drum with light. "Installation" indicates whether or not the pre-transfer static eliminator is installed. "Wavelength" indicates a light source wavelength in a case where the pre-transfer static eliminator is installed. "Light amount" indicates the amount of light with which a surface of the photo-conductor drum is irradiated in a case where the pre-transfer static eliminator is installed. "Potential after pre-transfer erase" indicates the potential of an image area and the potential of a non-image area when the photo-conductor drum before transfer is irradiated with light from the pre-transfer static eliminator. "Transfer memory" indicates evaluation of transfer memory. "Scattering" indicates evaluation of scattering of toner.

The results of Examples will be described. As illustrated in FIG. 7, the evaluation machine of Example 1 is different from that of Comparative Example 2 in that the light source wavelength of the pre-transfer static eliminator in Example 1 is 800 nm, while that in Comparative Example 2 is 780 nm. In addition, Example 1 is different from Comparative Example 2 in that a difference in potential between an image area and a non-image area (hereinafter, simply referred to as a difference in potential) in Example 1 is 199 [V], while that in Comparative Example 2 is 216 [V]. In Example 1, evaluation of transfer memory is R3. Evaluation of scattering of toner is R3. The evaluation (R3) of scattering of toner in Example 1 was higher than evaluation (R2) in Comparative Example 2. This is considered to be because the difference in potential is 199 [V], which is equal to or lower than an upper limit value 200 [V] capable of suppressing scattering of toner in Example 1.

The evaluation machine of Example 2 is different from that of Example 1 in that the light source wavelength of Example 2 is 820 nm, while that of Example 1 is 800 nm. In addition, Example 2 is different from Example 1 in that a difference in potential in Example 2 is 99 [V], while that in Example 1 is 199 [V]. In Example 2, evaluation of transfer memory is R3. Evaluation of scattering of toner is R4. The evaluation (R4) of scattering of toner in Example 2 was higher than evaluation (R3) in Example 1. This is considered to be because scattering of toner could be further suppressed due to a large drop of the difference in potential in Example 2.

The evaluation machine of Example 3 is different from that of Example 1 in that the difference in potential in Example 3 is 201 [V], while that in Example 1 is 199 [V]. In Example 3, evaluation of transfer memory is R3. Evaluation of scattering of toner is R3. The evaluation (R3) of scattering of toner in Example 3 is the same as the evaluation (R3) in Example 1. This is considered to be because a difference between the difference in potential 201 [V] in Example 3 and the difference in potential 199 [V] in Example 1 was small.

The evaluation machine of Example 4 is different from that of Example 1 in that the evaluation machine of Example 4 includes a main static eliminator, while the evaluation machine of Example 1 includes no main static eliminator. In Example 4, evaluation of transfer memory is R4. Evaluation of scattering of toner is R3. The evaluation (R4) of transfer memory in Example 4 was higher than evaluation (R3) in Example 1. This is considered to be because by inclusion of the main static eliminator in the evaluation machine of Example 4, the potential of a non-image area could be returned to a predetermined potential, and it was difficult to cause transfer memory.

The evaluation machine of Example 5 is different from that of Example 1 in that the type of CGL is "CG-1" in Example 5, while the type of CGL is "CG-9" in Example 1. In Example 4, evaluation of transfer memory is R3. Evaluation of scattering of toner is R3. The evaluation (R3) of transfer memory in Example 4 is not different from the evaluation (R3) in Example 1. In addition, the evaluation (R3) of scattering of toner in Example 4 is not different from the evaluation (R3) in Example 1. This indicates that the degrees of transfer memory and scattering of toner do not change depending on the type of CGL.

The evaluation machine of Example 6 is different from that of Example 1 in that the difference in potential of Example 6 is 198 [V], while that of Example 1 is 199 [V]. In Example 6, evaluation of transfer memory is R3. Evaluation of scattering of toner is R3. The evaluation (R3) of scattering of toner in Example 5 is not different from the evaluation (R3) in Example 1. This is considered to be because a difference between the difference in potential 198 [V] in Example 6 and the difference in potential 199 [V] in Example 1 was small.

The photo-conductor drum of Example 7 is different from that of Example 1 in that the photo-conductor drum of Example 7 has no OCL (overcoat layer), while the photo-conductor drum of Example 1 has OCL. In Example 7, evaluation of transfer memory is R4. Evaluation of scattering of toner is R3. The evaluation (R4) of transfer memory in Example 7 was higher than evaluation (R3) in Example 1. This is considered to be because the photo-conductor drum having no OCL makes it more difficult to cause transfer memory than the photo-conductor drum having OCL.

The photo-conductor drum of Example 8 is different from that of Example 1 in that the photo-conductor drum of Example 8 has no OCL, while the photo-conductor drum of Example 1 has OCL. In addition, the evaluation machine of Example 8 is different from that of Example 1 in that the evaluation machine of Example 8 includes a main static eliminator, while the evaluation machine of Example 1 includes no main static eliminator. In Example 8, evaluation of transfer memory is R5. Evaluation of scattering of toner is R3. The evaluation (R5) of transfer memory in Example 8 was much higher than evaluation (R3) in Example 1. This is considered to be because the photo-conductor drum having no OCL in Example 8 made it more difficult to cause transfer memory than the photo-conductor drum having OCL. In addition, this is considered to be because the main static eliminator in Example 8 could return the potential of a non-image area to a predetermined potential, and made it difficult to cause transfer memory.

Example 9 is different from Example 5 in that a difference in potential of Example 9 is 101 [V], while that of Example 5 is 194 [V]. In Example 9, evaluation of transfer memory is R3. Evaluation of scattering of toner is R4. The evaluation (R4) of scattering of toner in Example 9 was higher than evaluation (R3) in Example 5. This is considered to be because an effect of suppressing scattering of toner was enhanced due to a large drop of the difference in potential from an upper limit value 200 [V] in Example 8.

The evaluation machine of Example 10 is different from that of Example 9 in that the type of CGL is "CG-9" in Example 10, while the type of CGL is "CG-1" in Example 9. In Example 10, evaluation of transfer memory is R3. Evaluation of scattering of toner is R4. The evaluation (R3) of transfer memory in Example 10 is not different from the evaluation (R3) in Example 9. In addition, the evaluation (R4) of scattering of toner in Example 10 is not different from the evaluation (R4) in Example 9. This indicates that the degrees of transfer memory and scattering of toner do not change depending on the type of CGL.

The photo-conductor drum of Example 11 is different from that of Example 10 in that the photo-conductor drum of Example 11 has no OCL, while the photo-conductor drum of Example 10 has OCL. In Example 11, evaluation of transfer memory is R4. Evaluation of scattering of toner is R4. The evaluation (R4) of transfer memory in Example 11 was higher than evaluation (R3) in Example 10. This is considered to be because the photo-conductor drum having no OCL as in Example 11 made it more difficult to cause transfer memory than the photo-conductor drum having OCL.

Example 12 is different from Example 10 in that the light source wavelength of the pre-transfer static eliminator is 850 nm, the light amount is 30 μW, and the difference in potential is 6 [V] in Example 12, while the light source wavelength is 820 nm, the light amount is 13 μW, and the difference in potential is 100 [V] in Example 10. In Example 12, evaluation of transfer memory is R3. Evaluation of scattering of toner is R4. The evaluation (R3) of transfer memory in Example 12 is not different from the evaluation (R3) in Example 10. In addition, the evaluation (R4) of scattering of toner in Example 12 is not different from the evaluation (R4) in Example 10. This indicates that the degrees of transfer memory and scattering of toner do not change depending on the light source wavelength and the light amount or by drop of a difference in potential from 100 [V] to 6 [V].

Example 13 is different from Example 12 in that a difference in potential in Example 13 is 0 [V], while that in Example 12 is 6 [V]. In Example 13, evaluation of transfer memory is R3. Evaluation of scattering of toner is R5. The evaluation (R5) of scattering of toner in Example 13 was higher than evaluation (R4) in Example 12. This is considered to be because an effect of suppressing scattering of toner was enhanced by the drop of the difference in potential to an upper limit value 0 [V] in Example 13.

Next, Comparative Examples will be described. In Comparative Example 1, evaluation of transfer memory is R1. Evaluation of scattering of toner is R3. This is considered to be because the evaluation machine of Comparative Example 1 includes no pre-transfer static eliminator, and therefore scattering of toner does not occur, but occurrence of transfer memory cannot be prevented.

The evaluation machine of Comparative Example 2 is different from that of Example 1 in that the light source wavelength of the pre-transfer static eliminator is 780 nm, and the difference in potential is 216 [V] in Comparative Example 2, while the light source wavelength is 800 nm, and the difference in potential is 199 [V] in Example 1. In Comparative Example 2, evaluation of transfer memory is R3. Evaluation of scattering of toner is R2. The evaluation (R2) of scattering of toner in Comparative Example 2 was lower than evaluation (R3) in Example 1. This is considered to be because the difference in potential in Comparative Example 2 exceeded an upper limit value 200 [V].

The photo-conductor drum of Comparative Example 3 is different from that of Comparative Example 1 in that the photo-conductor drum of Comparative Example 3 has no OCL, while the photo-conductor drum of Comparative Example 1 has OCL. In Comparative Example 3, evaluation of transfer memory is R2. Evaluation of scattering of toner is R3. The evaluation (R2) of transfer memory in Comparative Example 3 was higher than evaluation (R1) in Comparative Example 1. This is considered to be because the photo-conductor drum having no OCL as in Comparative Example 3 made it more difficult to cause transfer memory than the photo-conductor drum having OCL.

Comparative Example 4 is different from Example 7 in that a difference in potential of Comparative Example 4 is 205 [V], while that of Example 7 is 193 [V]. In Comparative Example 4, evaluation of transfer memory is R3. Evaluation of scattering of toner is R2. The evaluation (R2) of scattering of toner in Comparative Example 4 was lower than evaluation (R3) in Example 7. This is considered to be because the difference in potential in Comparative Example 4 exceeded an upper limit value 200 [V].

From the above experimental results, it has been found that it is necessary to dispose a pre-transfer static eliminator and to set, in pre-transfer erase, a difference in potential between an image area and a non-image area to 0 [V] or more and 200 [V] or less in order to prevent occurrence of transfer memory and to suppress scattering of toner.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus comprising:

a transferer including a plurality of image forming units, wherein each of the image forming units transfers a toner image formed on a surface of a photo-conductor onto an image carrier, and one of the image forming units transfers a toner image of cyan; and an irradiator that irradiates the surface of the photo-conductor before transfer with light such that a potential of an image area where the toner image has been formed and a potential of a non-image area where the toner image has not been formed in the photo-conductor before transfer satisfy formula (1):

$$0 \leq |Va| - |Vb| \leq 200 \text{ [V]} \quad (1)$$

where |Va| represents the potential of the image area after the surface of the photo-conductor before transfer is irradiated with light, and |Vb| represents the potential of the non-image area after the surface of the photo-conductor before transfer is irradiated with light, the irradiator being disposed only in the one of the image forming units that transfers a toner image of cyan.

2. The image forming apparatus according to claim 1, wherein the irradiator irradiates the surface of the photo-conductor before transfer with light such that the potential of the image area and the potential of the non-image area satisfy formula (2):

$$0 \leq |Va| - |Vb| \leq 100 \text{ [V]} \quad (2)$$

where |Va| represents the potential of the image area after the surface of the photo-conductor before transfer is irradiated with light, and |Vb| represents the potential of the non-image area after the surface of the photo-conductor before transfer is irradiated with light.

3. The image forming apparatus according to claim 1, wherein the irradiator irradiates the surface of the photo-conductor before transfer with light such that the potential of the image area and the potential of the non-image area satisfy formula (3):

$$5 \leq |Va| - |Vb| \leq 200 \text{ [V]} \quad (3)$$

where |Va| represents the potential of the image area after the surface of the photo-conductor before transfer is irradiated with light, and |Vb| represents the potential of the non-image area after the surface of the photo-conductor before transfer is irradiated with light.

4. The image forming apparatus according to claim 1, wherein the irradiator irradiates the surface of the photo-conductor before transfer with light such that the potential of the image area and the potential of the non-image area satisfy formula (4):

$$5 \leq |Va| - |Vb| \leq 100 \text{ [V]} \quad (4)$$

where |Va| represents the potential of the image area after the surface of the photo-conductor before transfer is irradiated with light, and |Vb| represents the potential of the non-image area after the surface of the photo-conductor before transfer is irradiated with light.

5. The image forming apparatus according to claim 1, wherein an overcoat layer containing a polymer compound is disposed on a surface of a charge transport layer of the photo-conductor.

6. The image forming apparatus according to claim 1, further comprising a post-transfer static eliminator that eliminates a charge remaining on the surface of the photo-conductor after transfer.

7. The image forming apparatus according to claim 1, wherein a peak of a wavelength of the light emitted by the irradiator is 800 nm or more.

8. The image forming apparatus according to claim 1, wherein a peak of a wavelength of the light emitted by the irradiator is 820 nm or more.

* * * * *